US009680202B2

(12) United States Patent
Irci et al.

(10) Patent No.: US 9,680,202 B2
(45) Date of Patent: Jun. 13, 2017

(54) ELECTRONIC DEVICES WITH ANTENNA WINDOWS ON OPPOSING HOUSING SURFACES

(71) Applicant: Apple Inc., Cupertino, CA (US)

(72) Inventors: Erdinc Irci, Sunnyvale, CA (US); Jerzy Guterman, Mountain View, CA (US); Mattia Pascolini, San Mateo, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 273 days.

(21) Appl. No.: 13/910,986

(22) Filed: Jun. 5, 2013

(65) Prior Publication Data

US 2014/0361932 A1 Dec. 11, 2014

(51) Int. Cl.

| | |
|---|---|
| ***H01Q 1/24*** | (2006.01) |
| ***H01Q 1/22*** | (2006.01) |
| ***H01Q 21/28*** | (2006.01) |

(52) U.S. Cl.

CPC ..... *H01Q 1/243* (2013.01); *H01Q 1/2266* (2013.01); *H01Q 21/28* (2013.01)

(58) Field of Classification Search

CPC ..... H01Q 1/2266; H01Q 1/40; H01Q 1/42; H01Q 1/422; H01Q 1/241–1/244

USPC ..... 343/702, 767, 872, 873

See application file for complete search history.

(56) References Cited

U.S. PATENT DOCUMENTS

| | | | |
|---|---|---|---|
| 4,509,056 | A | 4/1985 | Ploussios et al. |
| 5,258,892 | A | 11/1993 | Stanton et al. |
| 5,463,406 | A | 10/1995 | Vannatta et al. |
| 5,608,413 | A | 3/1997 | Macdonald |

(Continued)

FOREIGN PATENT DOCUMENTS

| | | |
|---|---|---|
| CN | 1897355 | 1/2007 |
| CN | 101884135 | 11/2010 |

(Continued)

OTHER PUBLICATIONS

"AirPort Product-Specific Details", AirPort Developer Note, [Online], Updated: Apr. 28, 2008, Retrieved: Sep. 25, 2008, <http://developer.apple.com/documentation/HardwareDrivers/Conceptual/Hwrech_AirportjArticles/ El AirP_implementation.html>.

(Continued)

*Primary Examiner* — Jessica Han
*Assistant Examiner* — Awat Salih
(74) *Attorney, Agent, or Firm* — Treyz Law Group, P.C.; G. Victor Treyz; Michael H Lyons

(57) ABSTRACT

An electronic device housing may have a base unit and a lid. Aligned antenna windows may be formed on opposing upper and lower surfaces of the base unit along a hinge. Antenna structures that are located between respective upper and lower antenna windows on the upper and lower surfaces may be based on a pair of antennas that are coupled to switching circuitry that can select which antenna to switch into use or may be based on an antenna having a position that may be adjusted relative to the upper and lower antenna windows using a mechanical coupling to the lid or using a positioner. A sensor such as a lid position sensor may monitor how the lid is positioned relative to the base unit. Information from the lid position sensor may be used in adjusting the antenna structures to optimize performance.

21 Claims, 12 Drawing Sheets

(56) References Cited

U.S. PATENT DOCUMENTS 5,649,306 A * 7/1997 Vannatta ..... H01Q 1/084 343/702
5,784,032 A 7/1998 Johnston et al.
5,917,458 A 6/1999 Ho et al.
6,184,845 B1 2/2001 Leisten et al.
6,272,356 B1 8/2001 Dolman et al.
6,301,489 B1 10/2001 Winstead et al.
6,307,512 B1 10/2001 Geeraert
6,380,899 B1 4/2002 Madsen et al.
6,392,605 B2 5/2002 Anterow
6,392,610 B1 5/2002 Braun et al.
6,414,643 B2 7/2002 Cheng et al.
6,421,029 B1 7/2002 Tanabe
6,448,942 B2 9/2002 Weinberger et al.
6,456,249 B1 9/2002 Johnson
6,486,836 B1 11/2002 Hill
6,531,985 B1 3/2003 Jones et al.
6,539,608 B2 4/2003 McKinnon et al.
6,552,692 B1 4/2003 Zeilinger et al.
6,570,538 B2 5/2003 Vaisanen et al.
6,614,400 B2 9/2003 Egorov
6,636,181 B2 10/2003 Asano et al.
6,639,558 B2 10/2003 Kellerman et al.
6,667,719 B2 12/2003 LaKomski
6,781,546 B2 8/2004 Wang et al.
6,791,506 B2 9/2004 Suganthan et al.
6,819,287 B2 11/2004 Sullivan et al.
6,847,329 B2 1/2005 Ikegaya et al.
6,861,989 B2 3/2005 Morningstar et al.
6,885,880 B1 4/2005 Ali
6,987,485 B2 1/2006 Ito et al.
6,995,718 B2 2/2006 Fang
7,053,850 B1 5/2006 Bogdans et al.
7,068,229 B2 6/2006 Lin
7,181,172 B2 2/2007 Sullivan et al.
7,183,983 B2 2/2007 Ozden
7,339,530 B2 3/2008 Ying et al.
7,345,646 B1 3/2008 Lin et al.
7,447,530 B2 11/2008 Iwai et al.
7,457,650 B2 * 11/2008 Iwai ..... H01Q 1/242 343/702
7,525,493 B2 * 4/2009 Iwai et al. ..... 343/702
7,551,142 B1 6/2009 Zhang et al.
7,595,759 B2 9/2009 Schlub et al.
7,639,190 B2 12/2009 Shimasaki et al.
7,671,804 B2 * 3/2010 Zhang et al. ..... 343/700 MS
7,705,789 B2 4/2010 Suzuki et al.
7,750,854 B2 7/2010 Wedel et al.
7,768,461 B2 8/2010 Cheng et al.
7,768,462 B2 8/2010 Zhang et al.
7,804,458 B2 9/2010 Montgomery et al.
7,889,146 B2 * 2/2011 Halek ..... H01Q 1/04 343/771
7,916,089 B2 3/2011 Schlub et al.
8,054,232 B2 11/2011 Chiang et al.
8,059,039 B2 11/2011 Ayala Vazquez et al.
8,059,040 B2 11/2011 Ayala Vazquez et al.
8,159,399 B2 * 4/2012 Dorsey ..... H01Q 1/2266 343/702
8,264,412 B2 9/2012 Ayala et al.
8,269,675 B2 9/2012 Kough et al.
8,319,692 B2 11/2012 Chiang et al.
8,325,094 B2 * 12/2012 Ayala Vazquez .... H01Q 1/2258 343/700 MS
8,325,096 B2 12/2012 Ayala Vazquez et al.
8,482,469 B2 7/2013 Ayala et al.
8,508,418 B2 8/2013 Kough et al.
8,638,549 B2 1/2014 Garelli et al.
8,896,487 B2 * 11/2014 Chiang ..... G06F 1/1616 343/700 MS
8,971,833 B2 * 3/2015 Lashkari et al. ..... 455/296
9,203,137 B1 12/2015 Guterman et al.
9,350,068 B2 5/2016 Gutterman et al.
2001/0040529 A1 11/2001 Cheng
2002/0024469 A1 2/2002 Masaki
2002/0080565 A1 6/2002 Teshima
2002/0163473 A1 11/2002 Koyama
2002/0183032 A1 * 12/2002 Fang ..... G06F 1/1616 455/280
2003/0222823 A1 12/2003 Flint et al.
2004/0051670 A1 * 3/2004 Sato ..... G06F 1/1616 343/702
2004/0160370 A1 * 8/2004 Ghosh ..... G06F 1/1616 343/702
2004/0219956 A1 11/2004 Iwai et al.
2004/0257283 A1 12/2004 Asano et al.
2005/0041624 A1 2/2005 Hui et al.
2005/0062657 A1 3/2005 Lin
2006/0038736 A1 2/2006 Hui et al.
2006/0139220 A1 * 6/2006 Hirota et al. ..... 343/702
2006/0145931 A1 7/2006 Ranta
2006/0158379 A1 7/2006 Ishimiya
2006/0238437 A1 10/2006 Huang
2006/0244663 A1 11/2006 Fleck et al.
2007/0069958 A1 3/2007 Ozkar
2007/0126651 A1 6/2007 Snyder et al.
2007/0140072 A1 6/2007 Agrawal et al.
2007/0164919 A1 * 7/2007 Lee ..... H01Q 13/10 343/770
2007/0200784 A1 * 8/2007 Gorrell ..... H01Q 1/38 343/841
2007/0216581 A1 * 9/2007 Cheng ..... H01Q 1/2266 343/702
2007/0236399 A1 * 10/2007 Cheng ..... H01Q 9/30 343/745
2008/0018542 A1 1/2008 Yamazaki et al.
2008/0018551 A1 * 1/2008 Cheng ..... G06F 1/1616 343/873
2008/0106478 A1 5/2008 Hill
2008/0143611 A1 6/2008 Wang
2008/0166004 A1 7/2008 Stanford et al.
2008/0231522 A1 9/2008 Montgomery et al.
2008/0258992 A1 10/2008 Tsai
2009/0051604 A1 2/2009 Zhang et al.
2009/0153411 A1 6/2009 Chiang et al.
2009/0174611 A1 7/2009 Schlub et al.
2009/0174612 A1 7/2009 Ayala et al.
2009/0243943 A1 10/2009 Mumbru et al.
2009/0273529 A1 11/2009 Liu
2010/0067186 A1 * 3/2010 Aya ..... G06F 1/1616 361/679.28
2010/0073241 A1 3/2010 Ayala Vazquez et al.
2010/0073242 A1 3/2010 Ayala Vazquez et al.
2010/0073243 A1 3/2010 Ayala Vazquez et al.
2010/0134361 A1 6/2010 Nakano
2010/0156741 A1 6/2010 Vazquez et al.
2010/0182205 A1 7/2010 Chiang
2010/0321255 A1 12/2010 Kough et al.
2011/0080703 A1 4/2011 Schlesener et al.
2012/0026048 A1 2/2012 Vazquez et al.
2012/0050114 A1 3/2012 Li et al.
2012/0068893 A1 3/2012 Guterman et al.
2012/0074988 A1 3/2012 Lashkari et al.
2012/0169550 A1 7/2012 Schlub et al.
2012/0229347 A1 * 9/2012 Jin ..... H01Q 1/243 343/702
2013/0003284 A1 1/2013 Massaro et al.
2013/0009833 A1 1/2013 Kough et al.
2013/0050032 A1 2/2013 Shiu et al.
2013/0093447 A1 * 4/2013 Nickel ..... H04W 24/06 324/750.16
2013/0127669 A1 5/2013 Han et al.
2013/0293425 A1 11/2013 Zhu et al.
2013/0321216 A1 12/2013 Jervis et al.
2015/0009076 A1 * 1/2015 Jang ..... H01Q 1/2266 343/702
2015/0255851 A1 9/2015 Guterman et al.
2015/0270599 A1 9/2015 Guterman et al.

(56) References Cited

U.S. PATENT DOCUMENTS

FOREIGN PATENT DOCUMENTS

| | | |
|---|---|---|
| EP | 1083622 | 3/2001 |
| EP | 1 739 785 | 1/2007 |
| JP | 2000004120 | 7/2000 |
| JP | 2004363848 | 12/2004 |
| JP | 2006527941 | 12/2006 |
| JP | EP3096402 | * 11/2016 |
| TW | 457743 | 10/2001 |
| TW | 200404246 | 3/2004 |
| TW | 200507336 | 2/2005 |
| TW | 200518563 | 6/2005 |
| TW | 200719543 | 5/2007 |
| TW | 200843205 | 11/2008 |
| TW | M412391 | 9/2011 |
| TW | 201145676 | 12/2011 |
| WO | 2004112187 | 12/2004 |
| WO | 2005 120164 | 12/2005 |
| WO | 2006018711 | 2/2006 |
| WO | 2009142000 | 11/2009 |

OTHER PUBLICATIONS

R. Brancroft, "A Commercial Perspective on the Development and Integration of an 802.11albig HiperLanNVLAN Antenna into Laptop Computers" Centurion Wireless Technologies, IEEE: ArtOntlas end Propagvtion itlarreeino. vol. 48. No. 4, Aug. 2006.

Wikipedia contributors, "MacBook Pro," Wikipedia, The Free Encyclopedia, [online] <http://en.wikipedia.org/w/index.php?title=MacBook_Pro&oldid=506131750>, retrieved Aug. 7.

Guterman et al., U.S. Appl. No. 14/640,787, filed Mar. 6, 2015.

Guterman et al., U.S. Appl. No. 14/202,860, filed Mar. 10, 2015.

Guterman et al., U.S. Appl. No. 14/733,839, filed Jun. 8, 2015.

* cited by examiner

ELECTRONIC DEVICES WITH ANTENNA WINDOWS ON OPPOSING HOUSING SURFACES

BACKGROUND

This relates generally to electronic devices, and more particularly, to electronic devices with wireless communications circuitry.

Electronic devices such as portable computers and handheld electronic devices are often provided with wireless communications capabilities. For example, electronic devices may have wireless communications circuitry to communicate using cellular telephone bands and to support communications with satellite navigation systems and wireless local area networks.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive components can affect radio-frequency performance, care must be taken when incorporating antennas into an electronic device that includes conductive structures.

It would therefore be desirable to be able to provide improved wireless communications circuitry for wireless electronic devices.

SUMMARY

An electronic device may have a housing in which components are mounted. The housing may have a base unit and a lid that are coupled by a hinge. The electronic device may be a laptop computer having a keyboard in the base unit and a display in the lid. The position of the lid relative to the housing may be adjusted by rotating the lid relative to the housing with the hinge.

Aligned antenna windows may be formed on opposing upper and lower surfaces of the base unit at one or more locations along the hinge. Antenna structures may be located between respective upper and lower antenna windows on the upper and lower surfaces.

The antenna structures may include upper and lower antennas that are coupled to switching circuitry. The switching circuitry can switch either the upper or the lower antenna into use. In response to determining that the lid is closed, the lower antenna can be used. In response to determining that the lid is open, the upper antenna can be used.

If desired, the antenna structures may be based on a single antenna. The antenna in this type of arrangement may be coupled to a positioner. The positioner may adjust the position of the antenna relative to the upper and lower antenna windows based on information on whether the lid is open or closed. A sensor such as a lid position sensor may monitor how the lid is positioned relative to the base unit. Information from the lid position sensor may be used in adjusting the antenna structures to optimize antenna performance. Mechanical coupling schemes for positioning the antenna based on lid position may also be used.

Further features of the invention, its nature and various advantages will be more apparent from the accompanying drawings and the following detailed description of the preferred embodiments.

DETAILED DESCRIPTION

Figure 1:
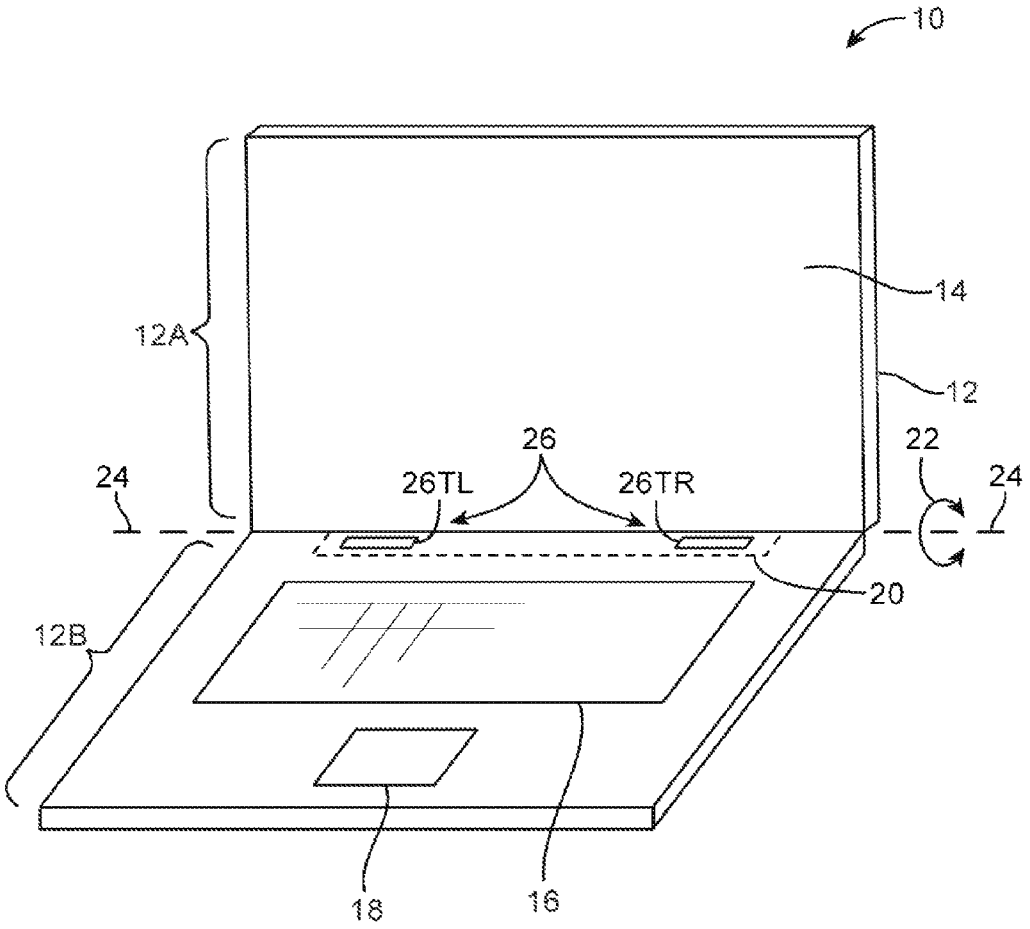
FIG. 1 is a perspective view of an illustrative electronic device such as a laptop computer of the type that may be provided with antennas in accordance with an embodiment of the present invention.

Electronic devices may include wireless circuitry. The wireless circuitry may include antenna structures. The antenna structures may include one or more antennas. Using radio-frequency transceiver circuitry coupled to the antennas, electronic devices may transmit and receive wireless signals. An electronic device of the type that may be provided with wireless circuitry is shown in FIG. 1. Electronic device 10 of FIG. 1 may be a laptop computer or other electronic device that has a folding lid or may be other electronic equipment. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. The electronic device configuration of FIG. 1 is shown as forming a laptop computer, but this is merely illustrative.

As shown in FIG. 1, electronic device 10 may have portions that move relative to each other such as upper housing 12A and lower housing 12B. Lower housing 12B may sometimes be referred to as a main housing or base housing. Upper housing 12A may sometimes be referred to as a lid or display housing.

Components such as keyboard 16 and touchpad 18 may be mounted on lower housing 12B. Device 10 may have hinge structures in region 20 that allow upper housing 12A to rotate in directions 22 about rotational axis 24 relative to lower housing 12B. Display 14 may be mounted in upper housing 12A. Upper housing 12A may be placed in a closed position by rotating upper housing 12A towards lower housing 12B about rotational axis 24.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 for device 10 includes display pixels formed from liquid crystal display (LCD) components, organic light-emitting diode display components, electrophoretic display components, plasma display components, or other suitable display pixel structures.

A display cover layer may cover the surface of display 14 or a display layer such as a color filter layer or other portion of a display may be used as the outermost (or nearly outermost) layer in display 14. The outermost display layer may be formed from a transparent glass sheet, a clear plastic layer, or other transparent member.

To prevent wireless antenna signals from being blocked, it may be desirable to form housing 12 or portions of housing 12 from dielectric. As an example, housing 12 may be formed form a dielectric such as plastic. If desired, housing 12 may be formed from a conductive material such as metal. With this type of configuration, openings in the metal of housing 12 may be filled with a dielectric such as plastic. The plastic in the openings of metal housing 12 may form antenna windows such as antenna windows 26 of FIG. 1.

There may be any suitable number of antenna windows in housing 12 of FIG. 1. As an example, there may be one or more, two or more, or three or more antenna windows on the upper surface of housing 12B of FIG. 1 and there may be one or more, two or more, or three or more antenna windows on the lower surface of housing 12B of FIG. 1. As shown in FIG. 1, there may be, for example, a pair of antenna windows 26 located along the hinge of device 10 in region 20 (i.e., upper left antenna window 26TL and upper right antenna window 26TR). As another example, there may be a single unified antenna window 26 on the upper surface of housing 12 along the hinge that covers two or more antennas (e.g., two or more antennas in two or more respective antenna cavities in housing 12). A respective rear surface antenna window 26 may also be provided that covers two or more antennas.

Figure 2:
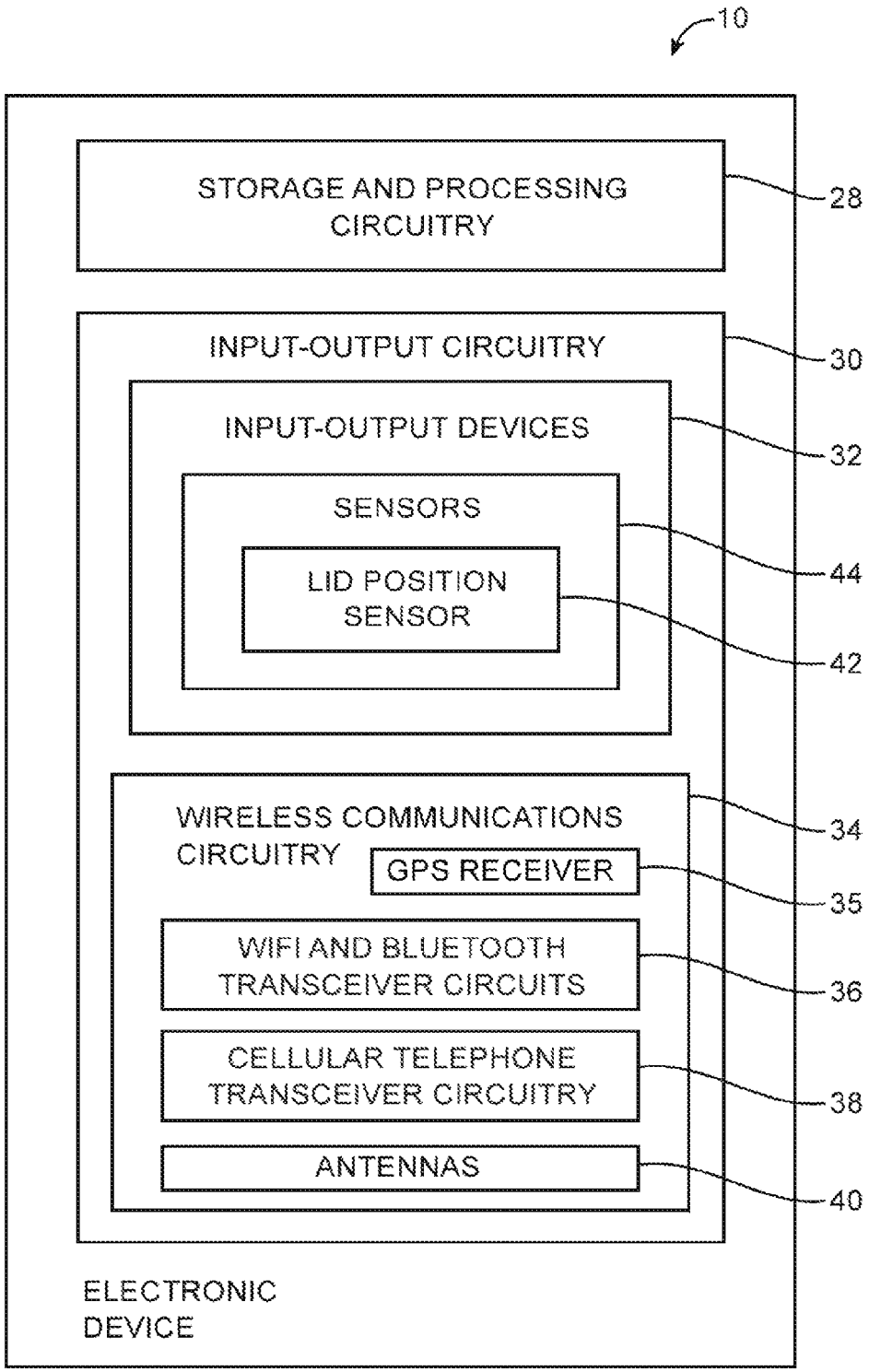
FIG. 2 is a schematic diagram of an illustrative electronic device in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VoIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, etc.

Circuitry 28 may be configured to implement control algorithms that control the use of antennas and other wireless circuitry in device 10. For example, circuitry 28 may perform signal quality monitoring operations, sensor monitoring operations, lid position monitoring operations, and other data gathering operations and may, in response to the gathered data (e.g., in response to information on lid position from lid position sensor 42) and in response to information on which communications bands are to be used in device 10, control which antenna structures within device 10 are being used to receive and process data, control one or more switches (e.g., switches to switch particular antennas into use), control the position of one or more antennas relative to the housing of device 10, control tunable elements, or may control other components in device 10 to adjust antenna attributes (i.e., the position of one or more antennas, the selection of one or more antennas to serve as active antennas in device 10, or other antennas settings may be adjusted). As an example, circuitry 28 may control which of two or more antennas is being used to receive incoming radio-frequency signals, may control which of two or more antennas is being used to transmit radio-frequency signals, may position antenna(s) within device 10, may control the process of routing incoming data streams over two or more antennas in device 10 in parallel, may tune an antenna to cover a desired communications band, etc.

In performing these control operations, circuitry 28 may open and close switches, may turn on and off receivers and transmitters, may adjust impedance matching circuits, may configure switches in front-end-module (FEM) radio-frequency circuits that are interposed between radio-frequency transceiver circuitry and antenna structures (e.g., filtering and switching circuits used for impedance matching and signal routing), may adjust switches, tunable circuits, and other adjustable circuit elements that are formed as part of an antenna or that are coupled to an antenna or a signal path associated with an antenna, may adjust power amplifier gain settings, may control transceiver output powers, may adjust antenna locations using electrically controlled antenna positioners and/or manually operated antenna positioning structures and may otherwise control and adjust the components of device 10.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, light-emitting diodes and other status indicators, data ports, audio components such as microphones and speakers, etc.

Input-output devices 32 may also include sensors 44. For example, input-output devices 32 may include an ambient light sensor, a proximity sensor, an accelerometer, and one or more position sensors that measure the relative position between structures within device 10. As an example, device 10 may include a position sensor such as lid position sensor 42 that monitors the position of upper housing 12A relative to lower housing 12B. Lid position sensor 42 may be implemented using a switch (e.g., sensor 42 may be a binary position sensor that determines whether housing 12A is in a closed position or is not in a closed position), may be implemented using an angle sensor (e.g., a sensor that produces an output that represents the angular orientation of upper housing 12A relative to lower housing 12B about rotational axis 24), or may be implemented using other position sensitive sensor structures that monitor the status of upper housing (lid) 12A.

During operation, a user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, filters, duplexers, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Wireless local area network transceiver circuitry such as transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2700 MHz or bands at higher or lower frequencies.

Wireless communications circuitry 34 can include circuitry for other short-range and long-range wireless links if desired. For example, wireless communications circuitry 34 may include wireless circuitry for receiving radio and television signals, paging circuits, etc. Near field communications may also be supported (e.g., at 13.56 MHz). In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may have antenna structures such as one or more antennas 40. Antenna structures 40 may be formed using any suitable antenna types. For example, antenna structures 40 may include antennas with resonating elements that are formed from loop antenna structures, patch antenna structures, inverted-F antenna structures, dual arm inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna and another type of antenna may be used in forming a remote wireless link. Antenna structures in device 10 such as one or more of antennas 40 may be provided with one or more antenna feeds, fixed and/or adjustable components, and optional parasitic antenna resonating elements so that the antenna structures cover desired communications bands.

Device 10 may have housing structures that move relative to each other during operation of device 10 by a user. In some configurations, these movable housing structures may block antennas or otherwise affect antenna structures in device 10. As an example, device 10 may have a movable housing structure such as lid 12A.

Figure 3:
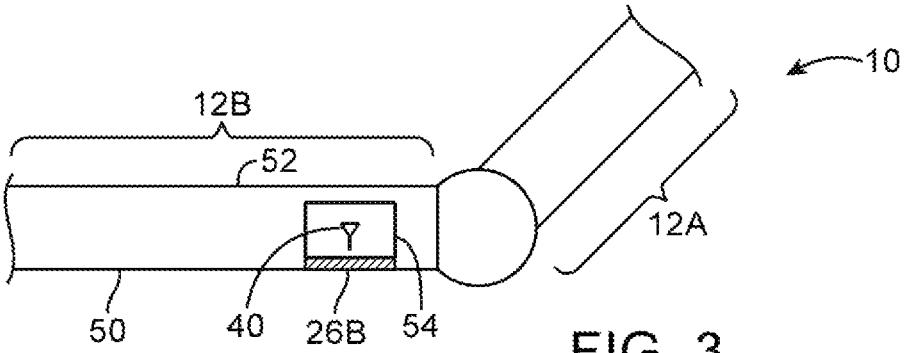
FIG. 3 is a cross-sectional side view of a portion of an illustrative laptop computer showing how an antenna may be mounted within housing structures so as to transmit and receive wireless signals through a lower (downward facing) antenna window in accordance with an embodiment of the present invention.

As shown in the cross-sectional side view of FIG. 3, device 10 may have one or more antennas 40 that are mounted so as to transmit and receive wireless radio-frequency signals through lower antenna window structures in housing 12 such as lower antenna window 26B of FIG. 3. Antennas 40 may, for example, be mounted in a conductive cavity or other structure 54 within lower housing 12B in a configuration that allows wireless signals to be transmitted and received through lower antenna window structure 26B on lower planar surface 50 of lower housing 12B without transmitting or receiving wireless signals through upper planar surface 52 of lower housing 12B.

Figure 4:
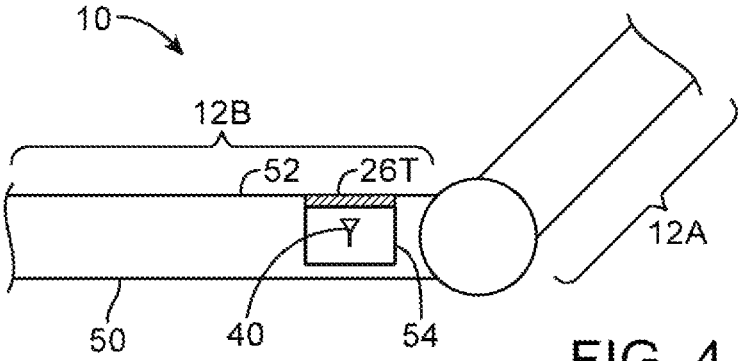
FIG. 4 is a cross-sectional side view of a portion of an illustrative laptop computer showing how an antenna may be mounted within housing structures so as to transmit and receive wireless signals through an upper (upward facing) antenna window in accordance with an embodiment of the present invention.

In the illustrative configuration of FIG. 4, upper antenna window 26T has been formed on upper planar surface 52 of lower housing 12B of device 10. One or more antennas such as antenna 40 may be located in a conductive cavity or other structure 54 within lower housing 12B in a configuration that allows wireless signals to be transmitted and received through upper antenna window structure 26T without transmitting or receiving signals through lower planar surface 50 of lower housing 12B.

Figure 5:
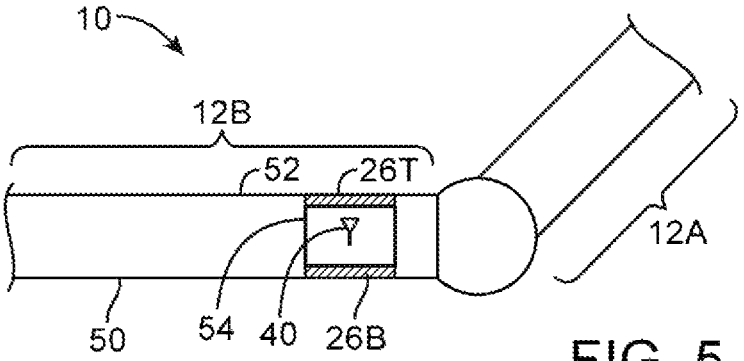
FIG. 5 is a cross-sectional side view of a portion of an illustrative laptop computer showing how an antenna may be mounted within housing structures so as to transmit and receive wireless signals through upper and lower antenna windows in accordance with an embodiment of the present invention.

As shown in FIG. 5, device 10 may, if desired, have both upward facing and downward facing antenna windows that are aligned above and below antenna structures 40. As an example, one or more antennas 40 may be mounted in cavity 54 or other structures in housing 12B in alignment with upper antenna window 26T on upper planar surface 52 of housing 12B and in alignment with corresponding lower antenna window 26B on lower planar surface 50 of housing 12B. Planar lower surface 50 and planar upper surface 52 may lie parallel to each other. With this type of arrangement, wireless signals may be transmitted and received through upper antenna window 26T and/or lower antenna window 26B. Upper antenna window 26T may have the same size as lower antenna window 26B or may have a different size than lower antenna window 26B. When viewed from above, upper antenna window 26T may overlap lower window 26B exactly or may partly overlap lower antenna window 26B (as examples).

When lid 12A is in an open position, upper surface 52 of lower housing structure 12B may be uncovered by the metal associated with lid 12A. Antennas mounted under antenna windows on upper surface 52 (see, e.g., locations 26 of FIG. 1 and illustrative antenna windows 26T of FIGS. 4 and 5) may therefore operate without impairment from the presence of conductive metal structures in lid 12A. When lid 12A is in a closed position, however, there is a potential that antenna windows such as antenna windows 26T that are formed on the upper surface of housing 12B may be adversely affected by the presence of lid 12A. In particular, lid 12A may cover and electromagnetically block antennas under windows 26TL and 26TR of FIG. 1 or under windows 26T of FIGS. 4 and 5. Electromagnetic blocking may occur due the use of metal in forming the exterior surfaces of lid 12A and/or due to the use of displays or other conductive structures within lid 12A (e.g., a display in a plastic housing).

With configurations of the type shown in FIG. 3, there are no upper antenna windows that can be blocked by lid 12A, but lower window 26B may sometimes be blocked by a metallic table top, a lossy surface such as wood or a human body, or other structure on which device 10 is resting. With configurations of the type shown in FIG. 4, antenna window 26T will not be blocked by a structure on which device 10 is resting, but can be blocked when lid 12A is closed. Configurations of the type shown in FIG. 5 allow signals to pass through upper antenna window 26T when lid 12A is open (even if device 10 is resting on a conductive support surface) and/or through lower antenna window 26B (e.g., when lower antenna window 26B is not blocked, even if lid 12A is closed).

Configurations of the type shown in FIGS. 3, 4, and 5 may have a single antenna window on the upper surface that covers multiple antennas (and antenna cavities) and/or may have a single corresponding antenna window on the lower surface that covers the multiple antennas. Use of this type of unified antenna window structure may be cosmetically appealing. If desired, multiple antenna windows may be formed on the upper surface each of which covers one or more antennas and/or multiple corresponding antenna windows may be formed on the lower surface each of which covers one or more antennas.

It may be desirable to use an array of two or more antennas 40 in handling wireless signals for device 10. With one suitable arrangement, antennas 40 may be located under antenna windows that are formed in housing 12 at different locations along hinge axis 24 (or using a unified antenna window that overlaps multiple antenna locations).

Figure 6:
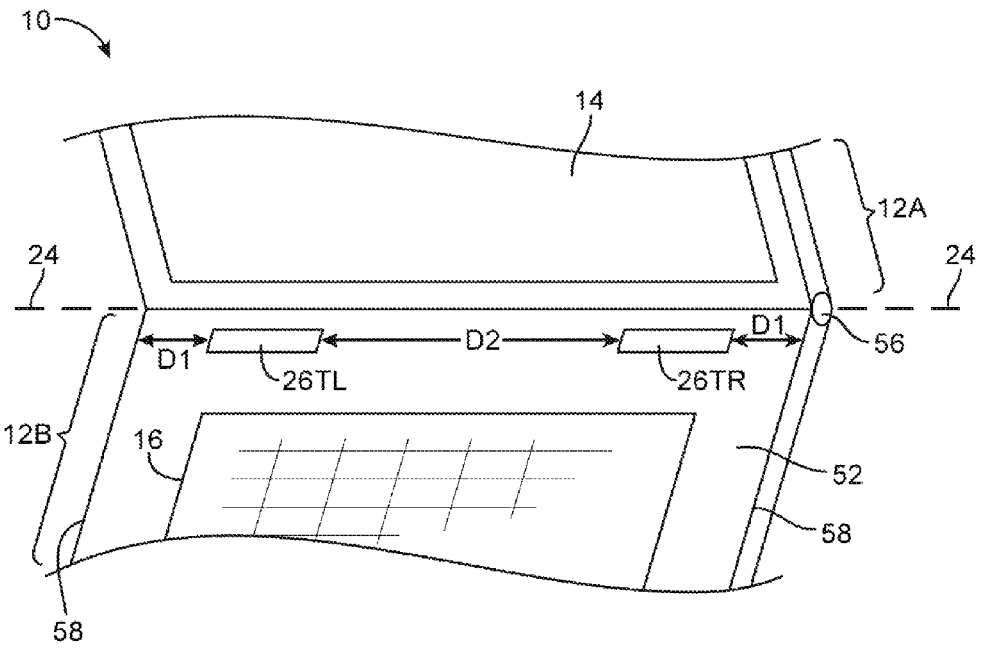
FIG. 6 is a front perspective view of a portion of an illustrative laptop computer showing how a pair of upper antenna windows may be located on the right and left sides of an upper surface of a base unit housing in accordance with an embodiment of the present invention.

As shown in the front perspective view of device 10 of FIG. 6, for example, upper antenna windows 26TL and 26TR may be formed in upper surface 52 of lower housing 12A adjacent to the hinge 56 at different positions along hinge axis 24. Windows 26TL and 26TR may be located a distance D1 from respective left and right edges 58 of housing 12B and may be separated from each other by a distance D2.

Figure 7:
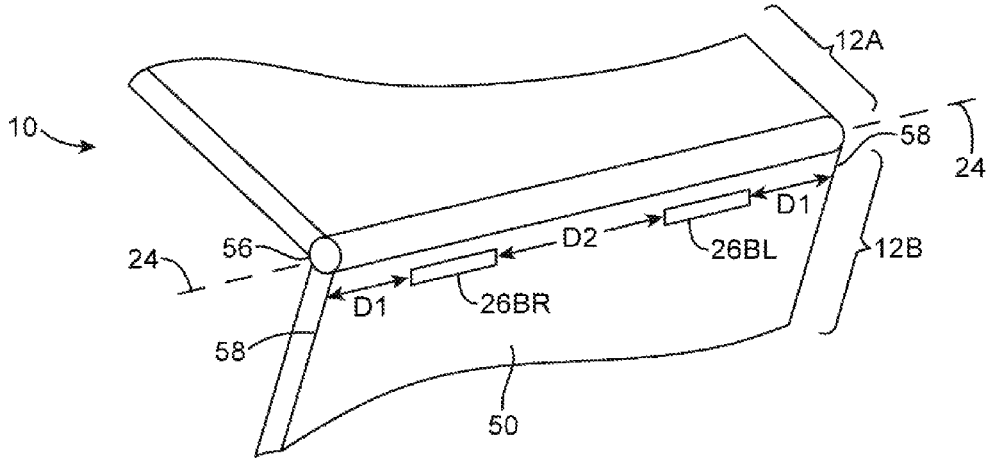
FIG. 7 is a rear perspective view of a portion of the illustrative laptop computer of FIG. 6 showing how a pair of lower antenna windows that correspond to the upper antenna windows of FIG. 6 may be located on the right and left sides of a lower surface of the base unit housing so as to overlap with the upper antenna windows of FIG. 6 in accordance with an embodiment of the present invention.

As shown in the rear perspective view of device 10 of FIG. 7, lower antenna windows may be formed in lower surface 50 of lower housing 12B. For example, lower antenna window 26BR may be formed on lower surface 50 in alignment with corresponding upper antenna window 26TR on opposing upper surface 52. Similarly, lower antenna window 26BL may be formed on lower surface 50 in alignment with corresponding upper antenna window 26TL on upper surface 52. Distance D1 may separate window 26BR from housing edge 58 and may separate window 26BL from housing edge 58. Distance D2 may separate windows 26BR and 26BL from each other, so that antennas 26BR and 26BL overlap respective antennas 26TR and 26TL when viewed from above or below the antenna windows. During operation of laptop 10 on a lap of a user, separations D1 may help ensure that antennas are located inboard of the user's legs, thereby helping to minimize emitted radiation directed towards the user's legs. Separation D2 may help minimize emitted radiation that is directed towards the user's hand and arm when the user is carrying device 10 with the user's hand between the antenna windows.

A first antenna structure (e.g., one or more antennas 40) may be located between windows 26TR and 26BR and a second antenna structure (e.g., one or more antennas 40)

may be located between windows 26TL and 26BL. As described in connection with windows 26B and 26T of FIG. 5, when an antenna is located between a pair of aligned upper and lower antenna windows in this way, wireless signals can enter and exit cavity 54 in housing 12 in a variety of operating conditions (e.g., with the lid open/closed, with the laptop resting on metal table or other conductive surface, etc.).

Figure 8:
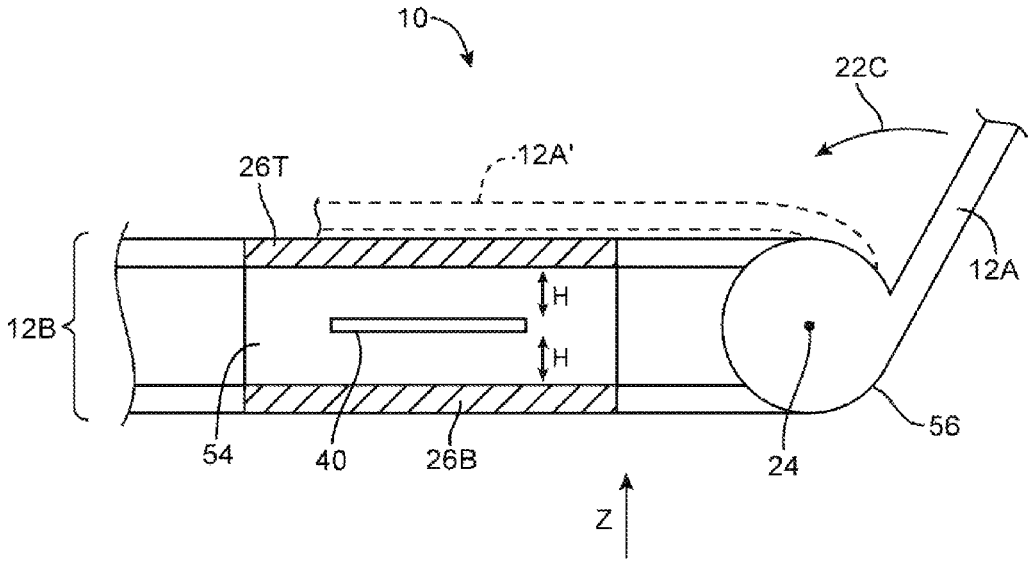
FIG. 8 is a cross-sectional side view of a portion of an illustrative laptop computer showing how an antenna may be mounted between opposing upper and lower antenna windows in a base unit housing in accordance with an embodiment of the present invention.

To ensure adequate antenna performance (i.e., satisfactory antenna efficiency) it may be desirable to locate each antenna 40 at a position that is midway in vertical dimension Z between the upper and lower antenna windows. As shown in FIG. 8, for example, it may be desirable to mount an antenna such as antenna 40 at a position that is equidistant from lower antenna window 26B and upper antenna window 26T. Antenna(s) 40 may be mounted in this position within device 10 to allow wireless operation through both upper antenna window 26T and lower antenna window 26B. When lid 12A is rotated in direction 22C about rotational axis 24 of hinge 56, lid 12A will move into a closed position (shown by lid 12A'). In this position, lid 12A will potentially block upper antenna window 26T. Lower antenna window 26B may, however, remain unblocked by lid 12A.

Antenna 40 of FIG. 8 may be located near the center of housing 12B, at a distance H from upper window 26T and at an equal distance H from lower window 26B. In configurations of the type shown in FIG. 8, the separation H between antenna 40 and the respective antenna windows in housing 12 may be larger than is desired for optimum antenna efficiency. To enhance wireless efficiency, antenna structures can be provided in which an antenna is moved between an upper position and a lower position as needed by a positioner or can be provided with a pair of antennas one of which is located at the upper antenna and one of which is located at the lower antenna.

Figure 9:
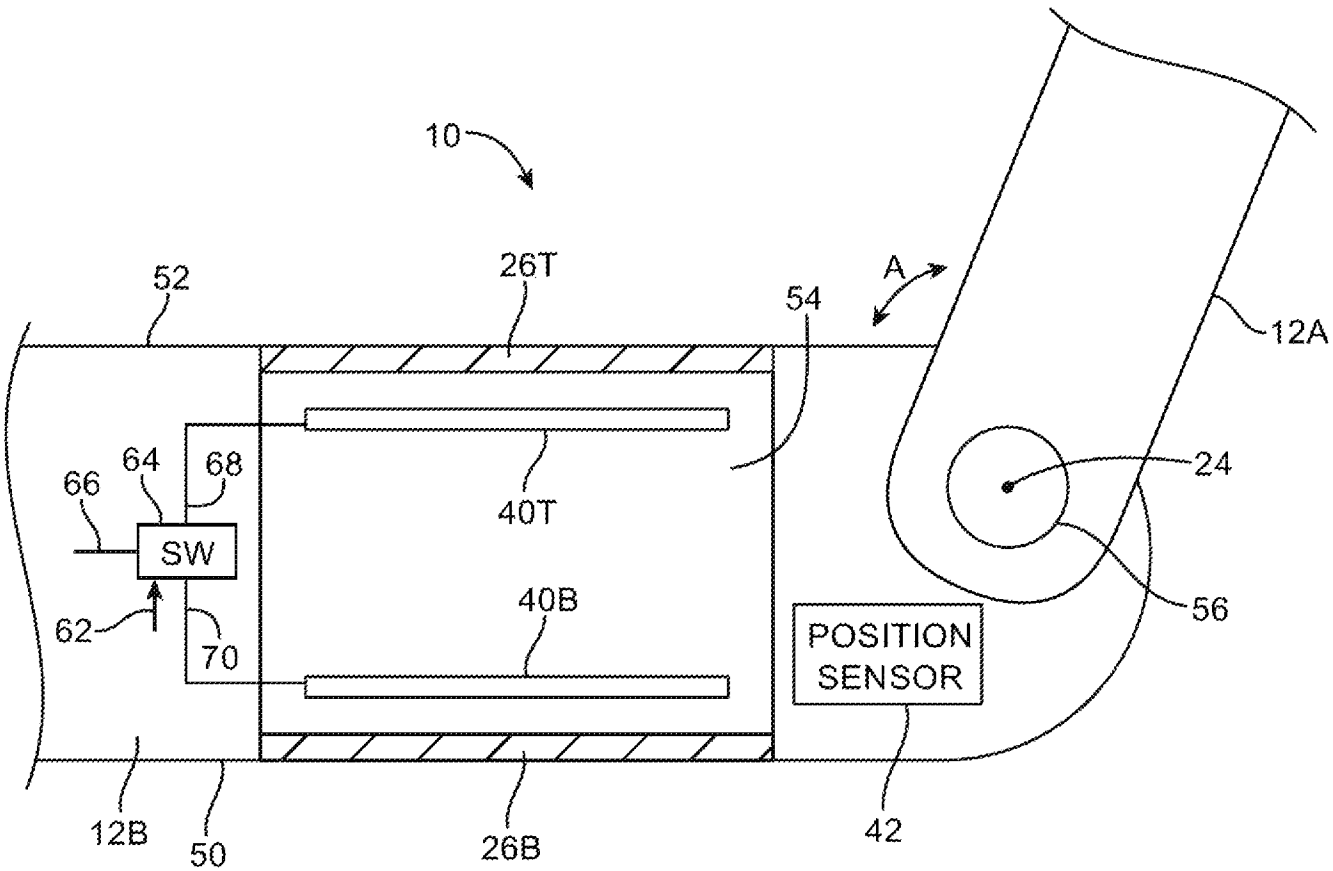
FIG. 9 is a cross-sectional side view of a portion of an illustrative laptop computer in which switching circuitry is being used to select between use of an antenna that is located adjacent to an upper antenna window and an antenna that is located adjacent to a lower antenna window based on information from a lid position sensor in accordance with an embodiment of the present invention.

As shown in FIG. 9, for example, device 10 may have a cavity or other internal structure in housing 12B such as cavity 54. A first antenna such as upper antenna 40T may be mounted in cavity 54 adjacent to upper antenna window 26T. A second antenna such as lower antenna 40B may be mounted in cavity 54 adjacent to lower antenna window 26L. Switching circuitry 64 may have a first port such as input 68 that is coupled to upper antenna 40T and may have a second port such as input 70 that is coupled to lower antenna 40B. Position sensor 42 may measure angle A of lid 12A relative to upper surface 52 of housing 12B and may supply lid position information to control circuitry 28. Control signals may be provided to switch 64 from control circuitry 28.

When lid 12A is open (i.e., when angle A is greater than a predetermined threshold), device 10 can conclude that antenna window 26T and antenna 40T will not be blocked by lid 12A. In response, switch 64 may be directed to couple path 68 to output path 66 to switch upper antenna 40T into use. When lid 12B is closed (i.e., when A is less than the predetermined threshold), device 10 can conclude that lid 12A is blocking antenna window 26T and antenna 40T. In response, switch 64 may be directed to couple path 70 to output path 66 to switch lower antenna 40B into use. Output path 66 may be a transmission line path that routes signals between the antenna that has been switched into use and transceiver circuitry in wireless communications circuitry 34.

The use of position sensor 42 and corresponding angular lid position information in controlling which of the antennas in cavity 54 is switched into use is merely illustrative. Any suitable criteria may be used in selecting which antenna to switch into use (e.g., binary open/closed lid status information, received signal strength information or other signal strength information indicating which antenna has been blocked, information from a capacitive proximity sensor indicating which antenna has been blocked, information from a light-based proximity sensor or other proximity sensor indicating which antenna has been blocked, or other information).

Figure 10:
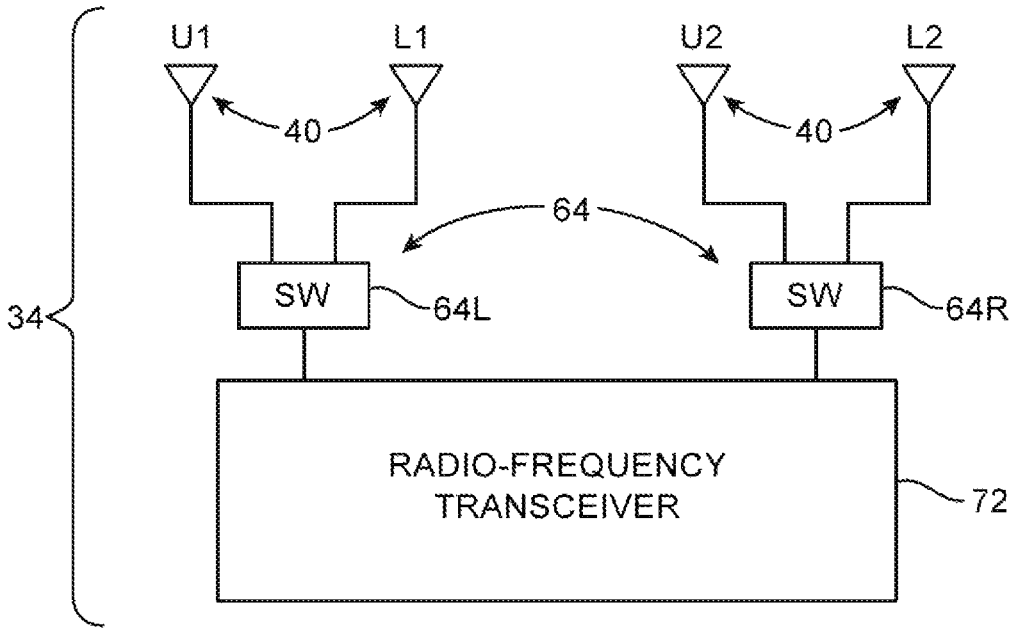
FIG. 10 is a schematic diagram that shows how a pair of upper antennas and a pair of lower antennas may be coupled to radio-frequency transceiver circuitry using switching circuitry in accordance with an embodiment of the present invention.

As shown in FIG. 10, there may be four antennas U1, L1, U2, and L2 in device 10. As an example, antenna U1 may be located adjacent to antenna window 26TL, antenna L1 may be located adjacent to antenna window 26BL, antenna U2 may be located adjacent to antenna window 26TR, and antenna L2 may be located adjacent to antenna window 26BR. Switch 64L may be used to switch either antenna U1 or L1 into use and switch 64R may be used to switch either antenna U2 or L2 into use. Switching decisions may be made by control circuitry 28 based on sensor data from lid position sensor 42 or other information.

Figure 11:
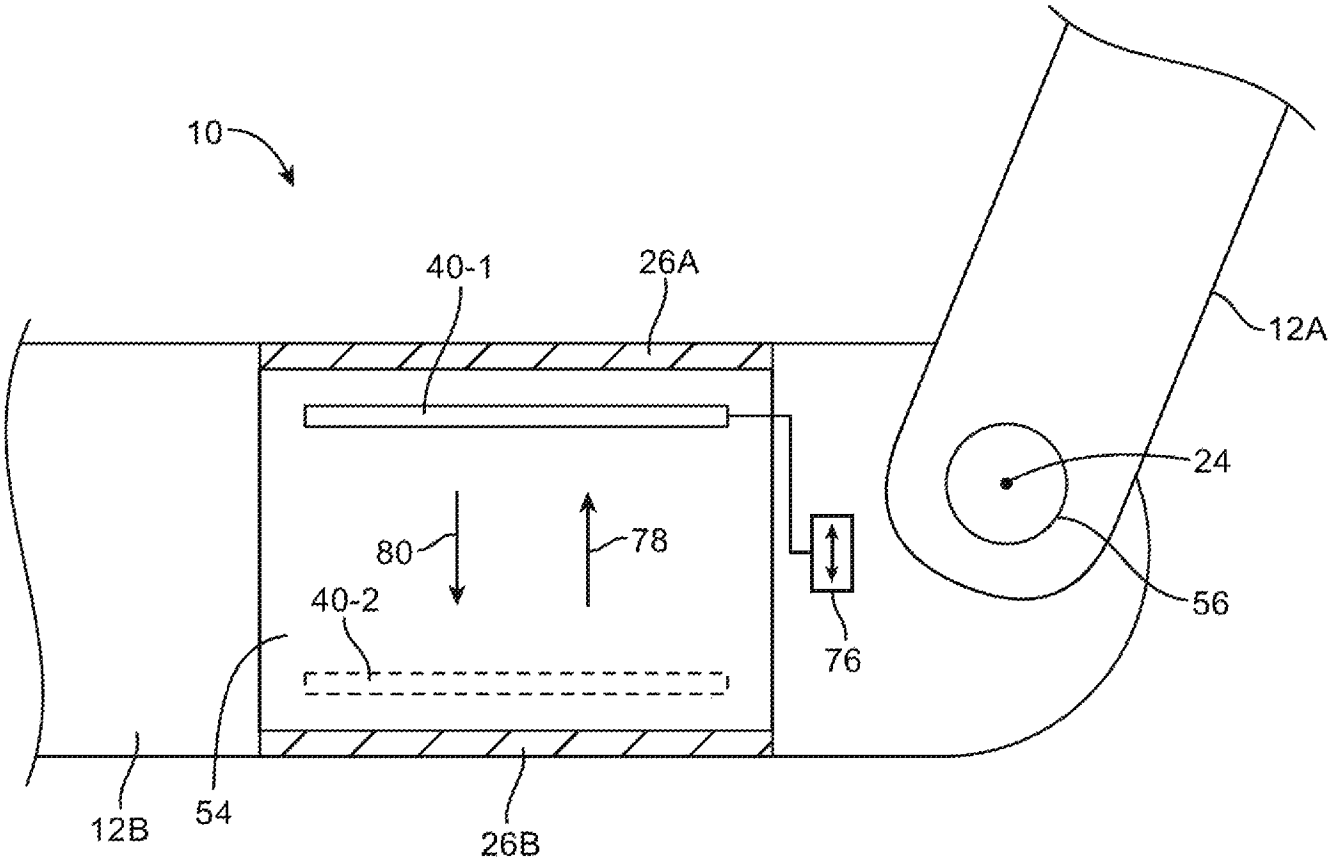
FIG. 11 is a cross-sectional side view of a portion of an illustrative laptop computer in which an antenna is being moved between a position in which the antenna is adjacent to an upper antenna window and a position in which the antenna is adjacent to a lower antenna window based on information from a lid position sensor in accordance with an embodiment of the present invention.

FIG. 11 shows how a positioner such as positioner 76 (e.g., a positioner controlled by control circuitry 28 based on lid position data from lid position sensor 42 or other data) may be used to move a single antenna between an upper position and a lower position. Positioner 76 may, for example, place an antenna in cavity 54 in lower housing 12B in upper position 40-1 adjacent to upper antenna window 26A by moving the antenna in upward direction 78 or may place the antenna in lower position 40-2 adjacent to lower antenna window 26B by moving the antenna in downward direction 80. Positioner 76 may include electromechanical positioning components such as a motor, a solenoid, or other mechanical actuator.

Figure 12:
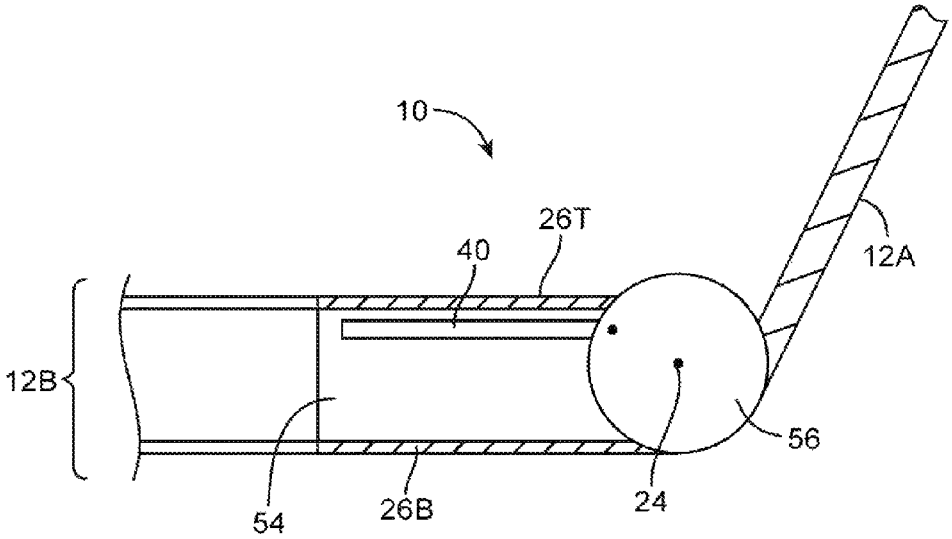
FIG. 12 is a cross-sectional side view of an illustrative laptop computer in which a lid has been placed in an open position and in which an antenna that is coupled to the lid has been moved into a corresponding position adjacent to an upper antenna window in a base unit housing in accordance with an embodiment of the present invention.
Figure 13:
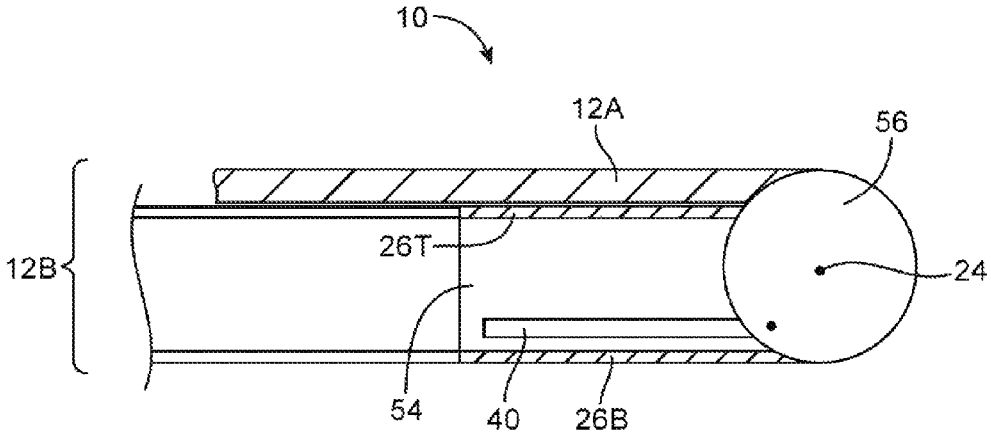
FIG. 13 is a cross-sectional side view of the illustrative laptop computer of FIG. 12 in which the lid has been placed in a closed position and in which the antenna that is coupled to the lid has been moved into a corresponding position adjacent to a lower antenna window in the base unit housing in accordance with an embodiment of the present invention.

If desired, an antenna in cavity 54 may be moved using mechanical positioning structures (e.g., structures coupled to movable lid 12A that move the antenna without using electromechanical components such as motor or solenoid components). This type of configuration is shown in the example of FIGS. 12 and 13. As shown in FIG. 12, antenna 40 may be mounted to hinge 56. When lid 12A is in its open position, antenna 40 may be positioned adjacent to upper antenna window 26T by virtue of clockwise rotation of hinge 56, as shown in FIG. 12. In this position, antenna performance will be high, because antenna 40 is close to window 26T and is unobstructed by lid 12A. When lid 12A has been rotated counterclockwise about rotational axis 24 using hinge 56 into the closed lid position of FIG. 13, antenna 40 will be rotated into the position shown in FIG. 13 in which antenna 40 is adjacent to lower antenna window 26B. This position for antenna 40 can potentially enhance antenna performance by avoiding the use of upper window 26T, which is blocked.

Figure 14:
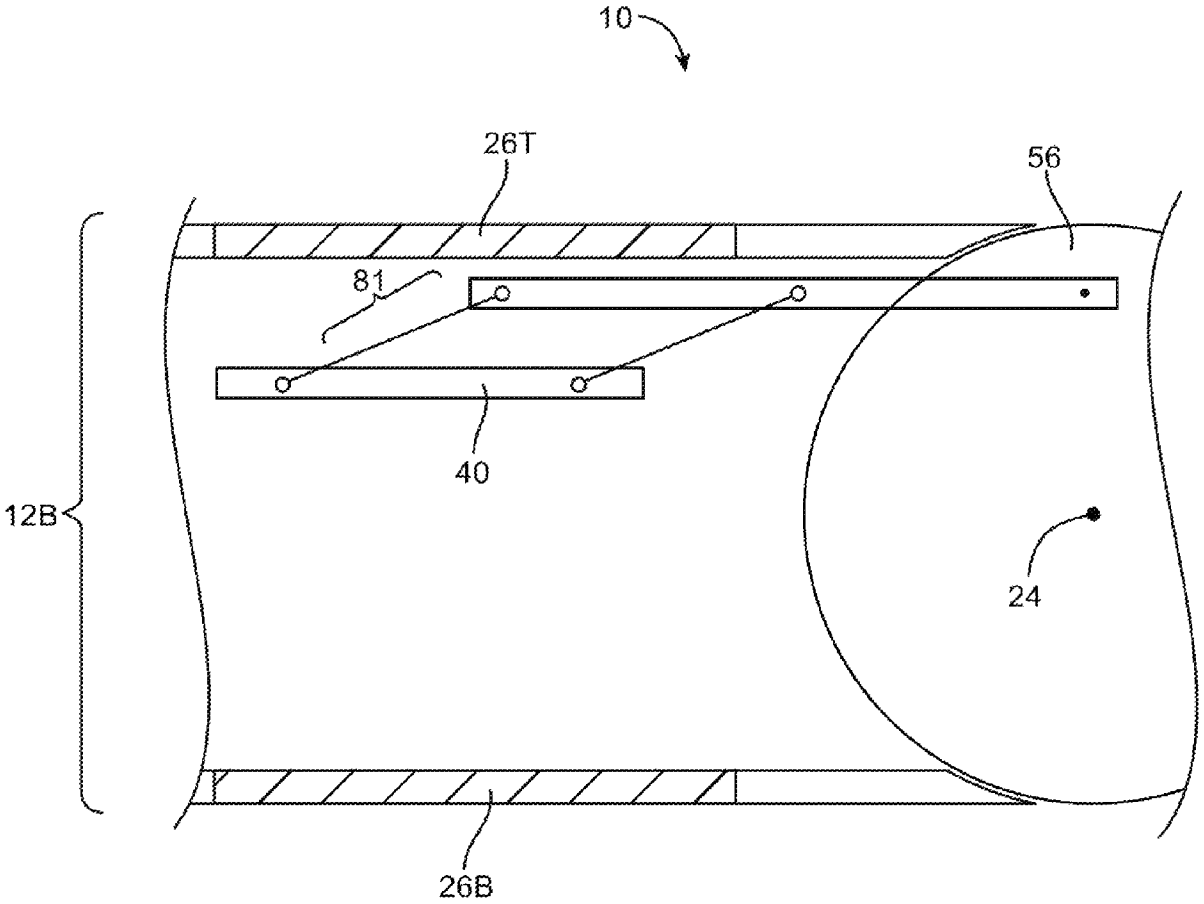
FIG. 14 is a cross-sectional side view of illustrative structures that may be used to position an antenna between upper and lower antenna windows in a laptop computer housing based on lid position in accordance with an embodiment of the present invention.
Figure 15:
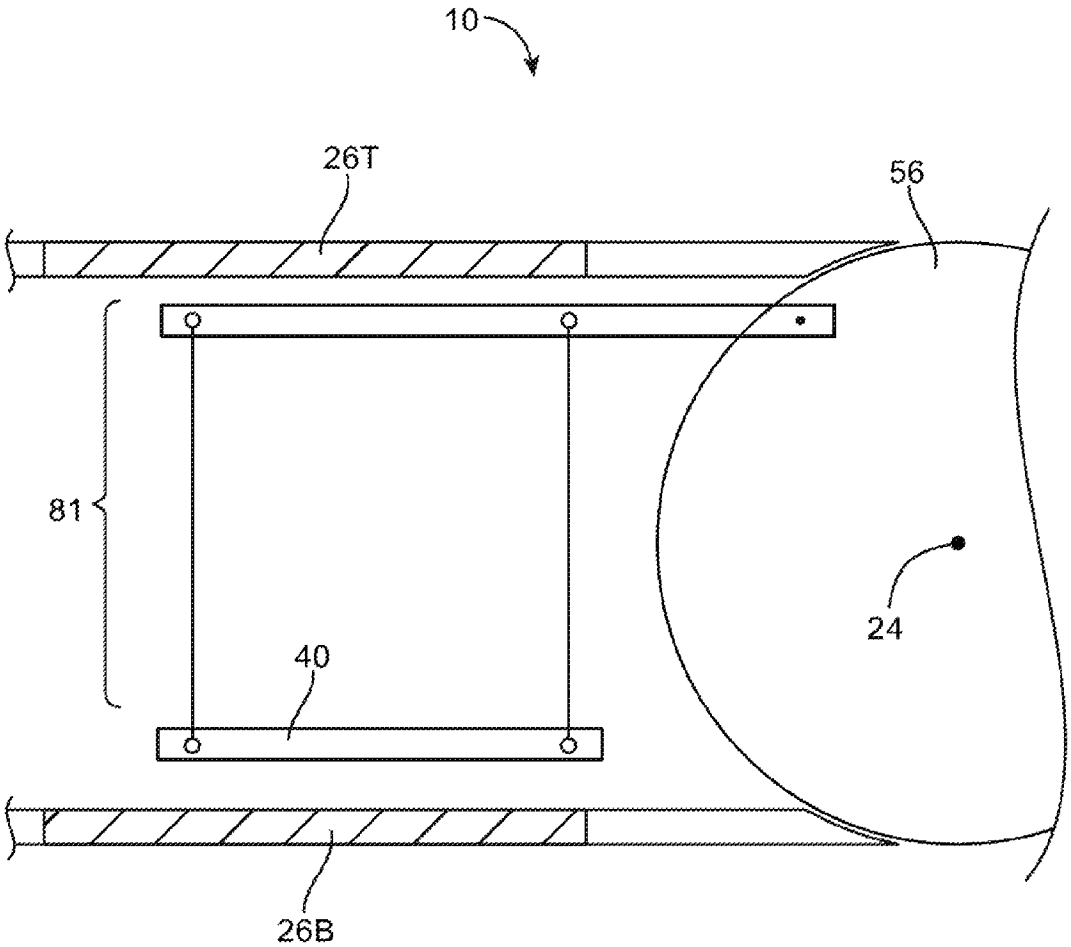
FIG. 15 is a cross-sectional side view of the illustrative structures of FIG. 14 in a configuration in which the lid has been closed and the antenna has been positioned adjacent to the lower antenna window in accordance with an embodiment of the present invention.

FIG. 14 is a cross-sectional side view of device 10 in a configuration in which a mechanical antenna positioning structure such as expandable support structure 81 is being used to position antenna 40 based on the position of lid 12A. When lid 12A is open, antenna 40 is located adjacent to upper antenna window 26T of FIG. 14. As shown in FIG. 15, rotation of hinge 56 counterclockwise (in the orientation of FIG. 15) when closing lid 12A causes expandable support structure 80 to expand and position antenna 40 adjacent to lower antenna window 26B.

Figure 16:
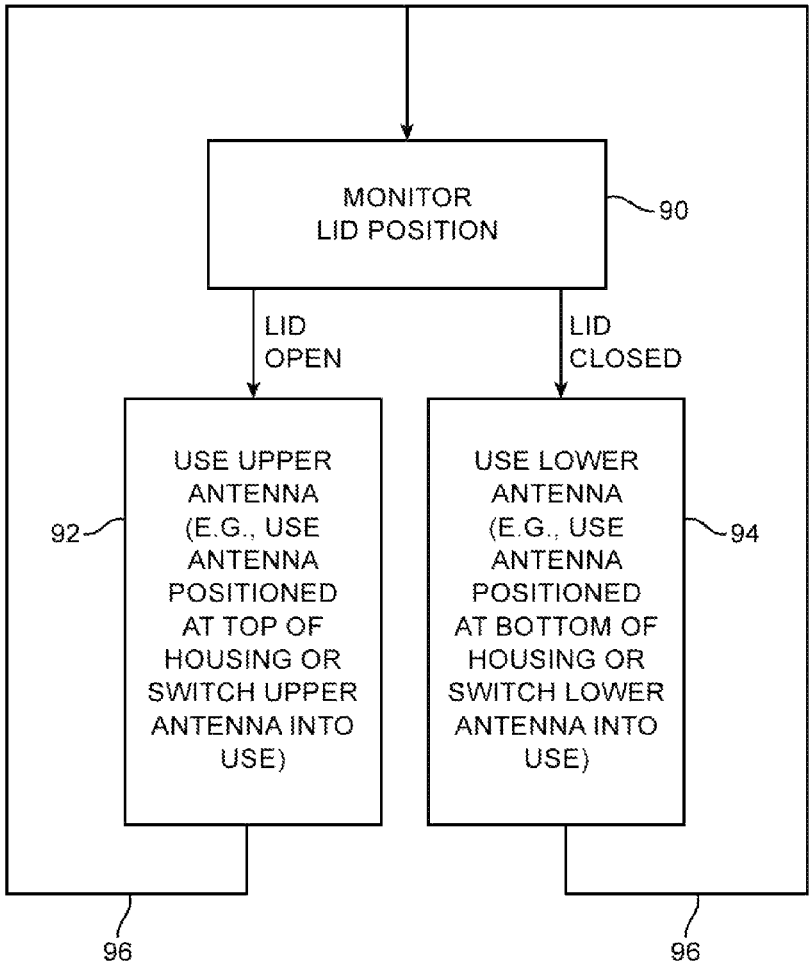
FIG. 16 is a flow chart of illustrative steps involved in operating an electronic device with a movable structure such as a lid and in selecting and using an appropriate antenna location for transmitting and receiving wireless signals based on lid position in accordance with an embodiment of the present invention.

If desired, device 10 may include one or more mechanically reconfigurable antennas in which the distance between each antenna window and each antenna varies as a function of lid angle. For example, a configuration of the type shown in FIG. 15 or a hinge with a slot and lever system and/or multiple slots and levers can be configured to produce a desired antenna position versus lid angle characteristic. As an example, the antenna positioning system may be configured so that below a first lid angle, the antenna is placed in a first position (i.e., a position in which the antenna is placed against the lower antenna window or is placed in the middle of the housing or another suitable position within the housing) and so that above a second lid angle, the antenna is placed in a second position (i.e., a position in which the antenna is placed against the upper antenna window or is placed at another suitable position within the housing). At lid angles between the first and second lid angles, the antenna may be positioned at intermediate positions between the first and second positions in proportion to the lid angle (e.g., in linear proportion to the lid angle, etc.). FIG. 16 is a flow chart of illustrative steps involved in operating an electronic device such as laptop computer 10 so that antenna performance is optimized. At step 90, control circuitry 28 may gather information on the operating state of device 10 such as information from one of sensors 44. As an example, control circuitry 28 may gather information on lid position (e.g., information on angle A between lid 12A and upper planar surface 52 of lower housing 12B, open/closed information, or other information on how the lid is positioned relative to the base of housing 12), control circuitry 28 may gather information on received wireless signal strength from transceiver circuitry in wireless communications circuitry 34, control circuitry 28 may gather information from a proximity sensor indicating whether certain antenna structures have been blocked by external objects and should therefore be switched out of use in favor of unblocked antenna structures, or control circuitry 28 may gather other information associated with the selection of which antenna window(s) to use in device 10.

If lid 12A is in an open position, an antenna 40 that is adjacent to upper antenna windows 26T (e.g., windows 26TR and/or 26TL) may be used in transmitting and receiving wireless signals (step 92). If lid 12B is in a closed position, an antenna 40 that is adjacent to lower antenna windows 26B (e.g., windows 26BR and/or 26BL) may be used in transmitting and receiving wireless signals (step 94). In mechanical antenna adjustment schemes in which antenna 40 is mechanically coupled to hinge 56, rotation of lid 12A into its open position will move antenna(s) 40 adjacent to the upper antenna window(s) of device 10 as part of step 92 and rotation of lid 12A into its closed position will move antenna(s) 40 adjacent to the lower antenna window(s) of device 10 as part of step 92. In arrangements in which lid position information from a lid position sensor or other device status information has been gathered at step 90, device 10 may use switching circuitry 64 to electrically switch the appropriate upper or lower antenna(s) into use and/or may use positioners such as positioner 76 of FIG. 11 to move antenna(s) into an appropriate upper or lower position in cavity 54 in response to the lid position information or other status information. As illustrated by lines 96, after a lid-position-appropriate configuration for antenna(s) 40 has been implemented, processing may return to step 90 for additional lid position monitoring using lid position sensor 42.

The foregoing is merely illustrative of the principles of this invention and various modifications can be made by those skilled in the art without departing from the scope and spirit of the invention.

What is claimed is:

1. An electronic device, comprising:

a first housing structure having opposing upper and lower conductive surfaces;

at least one upper antenna window in the upper conductive surface that is completely surrounded by the upper conductive surface;

at least one lower antenna window on the lower conductive surface that is completely surrounded by the lower conductive surface;

a second housing structure that is coupled to the first housing structure and that rotates relative to the first housing structure; and an antenna that is mounted within the first housing structure between the upper and lower antenna windows.

2. The electronic device defined in claim 1 wherein the first housing structure comprises a laptop computer base housing and the second housing structure comprises a laptop computer lid.

3. The electronic device defined in claim 2 further comprising:

a display in the laptop computer lid;

a keyboard in the laptop computer base housing; and radio-frequency transceiver circuitry coupled to the antenna.

4. The electronic device defined in claim 3 further comprising:

an additional antenna between the upper and lower antenna windows.

5. The electronic device defined in claim 4 wherein the antenna is adjacent to the upper antenna window, the additional antenna is adjacent to the lower antenna window, and the electronic device further comprises switching circuitry coupled between the antenna, the additional antenna, and the radio-frequency transceiver circuitry.

6. The electronic device defined in claim 5 wherein the switching circuitry is configured to switch a selected one of the antenna and the additional antenna into use to transmit and receive signals for the radio-frequency transceiver circuitry.

7. The electronic device defined in claim 6 further comprising a lid position sensor configured to monitor how the laptop computer lid is positioned relative to the laptop computer base housing.

8. The electronic device defined in claim 7 wherein the switching circuitry is configured to switch the selected one of the antenna and the additional antenna into use based on information from the lid position sensor.

9. The electronic device defined in claim further comprising a positioner that positions the antenna relative to the upper and lower antenna windows.

10. The electronic device defined in claim 9 further comprising a lid position sensor configured to monitor how the laptop computer lid is positioned relative to the laptop computer base housing, wherein the positioner is configured to position the antenna relative to the upper and lower antenna windows based on information from the lid position sensor.

11. The electronic device defined in claim 3 wherein the laptop computer lid is configured to position the antenna adjacent to the upper antenna window in response to opening the laptop computer lid and is configured to position the antenna adjacent to the lower antenna window in response to closing the laptop computer lid.

12. An electronic device, comprising:

a metal housing having opposing parallel planar upper and lower surfaces with respective upper and lower antenna windows;

upper and lower antennas, wherein the upper antenna is located between the upper antenna window and the lower antenna window, the lower antenna is located between the upper antenna window and the lower antenna window, the upper antenna is located adjacent to the upper antenna window, and the lower antenna is located adjacent to the lower antenna window;

a first transmission line structure directly connected to the upper antenna that conveys radio-frequency signals for the upper antenna; and a second transmission line structure directly connected to the lower antenna that conveys radio-frequency signals for the lower antenna, wherein the upper antenna window is completely enclosed by the planar upper surface of the metal housing and the lower antenna window is completely enclosed by the planar lower surface of the metal housing.

13. The electronic device defined in claim 12 further comprising:

radio-frequency transceiver circuitry that is coupled to the upper antenna through the first transmission line structure and that is coupled to the lower antenna through the second transmission line structure; and switching circuitry that selectively switches a given one of the upper and lower antennas into use by the radio-frequency transceiver circuitry.

14. The electronic device defined in claim 13 further comprising:

a housing structure that is configured to move relative to the metal housing; and a sensor that detects movement of the housing structure relative to the metal housing.

15. The electronic device defined in claim 14 wherein the switching circuitry is configured to selectively switch the given one of the upper and lower antennas into use based on information from the sensor.

16. The electronic device defined in claim 15 further comprising a hinge that couples the housing structure to the metal housing, wherein the housing structure covers the upper antenna window in a closed position for the housing structure, the upper antenna window is uncovered by the housing structure in an open position for the housing structure, the switching circuitry is configured to switch the upper antenna into use in response to detecting with the sensor that the housing structure is in the open position, and the switching circuitry is configured to switch the lower antenna into use in response to detecting with the sensor that the housing structure is in the closed position.

17. The electronic device defined in claim 13, further comprising:

proximity sensor circuitry that is configured to identify when a given one of the upper and lower antennas is being blocked by an external object, wherein the switching circuitry is configured to switch the given one of the upper and lower antennas that is being blocked by the external object out of use by the radio-frequency transceiver circuitry in response to identifying, with the proximity sensor circuitry, that the given one of the upper and lower antennas is being blocked by the external object.

18. A laptop computer, comprising:

a conductive base housing having a keyboard and having opposing upper and lower conductive surfaces;

a lid that is coupled to the conductive base housing and that rotates relative to the conductive base housing;

a display in the lid; and aligned upper and lower antenna windows formed respectively on the upper and lower conductive surfaces, wherein the upper antenna window is completely surrounded by the upper conductive surface and the lower antenna window is completely surrounded by the lower conductive surface.

19. The laptop computer defined in claim 18 further comprising additional aligned upper and lower antenna windows formed respectively on the upper and lower conductive surfaces.

20. The laptop computer defined in claim 18, further comprising a hinge that couples the conductive base housing to the lid, wherein the upper and lower antenna windows are interposed between the keyboard and the hinge.

21. The laptop computer defined in claim 20 further comprising:

radio-frequency transceiver circuitry;

switching circuitry coupled to the radio-frequency transceiver circuitry;

first antenna structures that are coupled to the switching circuitry and that are located between the upper and lower antenna windows; and second antenna structures that are coupled to the switching circuitry and that are located between the additional upper and lower antenna windows.

* * * * *